US005233943A

United States Patent [19]

Martin et al.

[11] Patent Number: 5,233,943

[45] Date of Patent: Aug. 10, 1993

[54] SYNTHETIC GAS RADIANT COOLER WITH INTERNAL QUENCHING AND PURGING FACILITIES

[75] Inventors: Michael C. Martin; George M. Gulko, both of Houston, Tex.

[73] Assignee: Texaco Inc., White Plains, N.Y.

[21] Appl. No.: 751,599

[22] Filed: Aug. 21, 1991

Related U.S. Application Data

[63] Continuation of Ser. No. 615,552, Nov. 19, 1990, abandoned.

[51] Int. Cl.[5] ..... F22D 1/00

[52] U.S. Cl. ..... 122/7 R; 122/504

[58] Field of Search ..... 122/7 R, 504, 504.2; 165/1

[56] References Cited

U.S. PATENT DOCUMENTS 4,707,163 11/1987 Gudymov et al. ..... 122/7 R X 4,768,470 9/1988 Ziegler ..... 122/7 R 4,936,376 6/1990 Martin et al. ..... 122/504.2

*Primary Examiner*—Edward G. Favors

*Attorney, Agent, or Firm*—James J. O'Loughlin; Robert B. Burns

[57] ABSTRACT

Radiant gas cooler apparatus for treating a particulate-laden synthetic gas, which cooler includes an elongated shell. A water wall in the shell defines an annulus communicated with a pressurized purge gas source. Hot effluent introduced to the unit passes through a heat exchange chamber defined by the water wall and enters a bath in the shell lower end wherein solid material is removed. Cooled synthetic gas which leaves the bath enters the annulus to be discharged into the bath. A regulated flow of purge gas directed into the annulus prevents entry of hot effluent gas therein, precludes the accumulation of residual solid particulate matter and corrosive gaseous components, and scours the annulus surfaces. A double dip tube arrangement also protects the vessel by equalizing the pressure across an internal water wall.

9 Claims, 2 Drawing Sheets

SYNTHETIC GAS RADIANT COOLER WITH INTERNAL QUENCHING AND PURGING FACILITIES

This application is a continuation of application Ser. No. 07/615,552, filed Nov. 19, 1990, abandoned.

BACKGROUND OF THE INVENTION

1. Field of the Invention

This invention relates in general to a radiant cooling unit, and more particularly to a synthetic gas cooling apparatus in which thermal protection is provided to avoid inadvertent operational damage The hot gas producing process utilizes a fuel comprised of finely ground coal, coke, or even a liquid fuel which is combusted in a controlled temperature atmosphere. The resulting effluent includes not only synthetic gas but also an amount of dust or fly ash which is separated into cooled gaseous and solid components.

2. Description of the Prior Art

Numerous heat exchangers and gas cooling design components known in the art are employed in different environments and for different applications. Cooling of hot synthetic gas from a gasifier of the type contemplated here, and the finely divided solids, such as powdered fly ash or slag, carried by the gas has heretofore utilized radiation boilers which functionally raise steam in water wall tubes. In such a boiler or heat exchanger, the solidified slag and cooled synthetic gas are removed at the lower end of a downflow radiation boiler. In commercial size plants and installations however, the radiation boiler dimensions could become a limiting factor where a single entrained throughput flow of the hot syngas is handled.

It is of further note that various structures for heat exchangers such as radiant waste heat boilers, are utilized for transferring or recovering heat from a flow of hot pressurized gas that is to be cooled. Many of these structures are not readily adapted to large scale flow of syngas. Also, there are known waste heat boilers that are characterized by a relatively complex structure, one such being described in U.S. Pat. No. 4,377,132.

Such structures, because of excessive heat and high pressure conditions under which they normally operate, are highly susceptible to damage in the event of a minor equipment malfunction. Further, the gas generation process could take an unexpected step as a result of undesired accumulations of the solid material from the hot produced gaseous effluent.

For example, a critical operating problem can result when the solid particulate matter is not completely removed from the effluent stream by water quenching or the like. Thus, the particles, as they leave the gasifier disengagement zone, and prior to being discharged, will tend to accumulate. The eventual results will be a solid mass or barrier to gas flow control thereby interfering with or completely retarding the normal gas flow from the radiant heating section.

An additional problem also encountered in the configuration of such coolers is the propensity for corrosive action on the unit's cooler walls and surfaces. More particularly, the cooling unit's outer shell wall, when shielded from heating by a protective inner wall, promotes condensation of hot gases which contain an amount of corrosive elements. An example of the latter is hydrogen chloride. When the latter comes into contact with a condensed water, the resulting acid will soon adversely affect any of the metal parts of the cooler with which it comes into contact.

Toward avoiding serious damage to a radiant type cooler of the type contemplated, the present invention affords a degree of protection against thermal as well as corrosive damage. The primary protection is provided through a "double dip tube" arrangement as well as a constant flow purge system communicated with the gasifier unit. The double-dip tube arrangement is designed in such a manner that no damage to the vessel will result if any plugging occurs in the region of the vessel's gas outlet nozzle. Unlike previous designs, the disclosed embodiment will ensure that if plugging does occur in this region, the differential pressure across the water wall will be equalized. These water walls are only capable of withstanding very small differential pressures, typically in the range of 10 to 15 psi. If differential pressures greater than the design level are experienced, then a rupture of the water wall could result. This circumstance would expose the vessel shell to excessively high temperatures which could result in the vessel's shell being ruptured.

The disclosed constant purge system acts to protect the surface of the external water wall by constantly sweeping the outer surface thereof, as well as the internal surface of the enclosing shell. This action avoids or at least minimizes the possibility of a breaching of one or both of these walls as a result of sustained contact with the hot gas and/or corrosive acids.

Both functions of the purge system, although in constant use, are preferably actuated in response to a monitor or sensing means positioned within the cooler. Thus, the constant flow of purge gas can be increased as necessary to a pressure and volume that will preclude entry of hot gases into the elongated annulus defined between the water wall and the shell.

It is therefore an object of the invention to provide a syngas cooler structure that is adapted for safely conducting a high temperature, particle-laden gaseous stream.

A further object is to provide a unit of the type contemplated which can function without damage under operating conditions including a high temperature environment in which a large amount of solids is carried in the hot gaseous stream and which is disposed of prior to their accumulating in flow passages.

Another object is to provide a heat exchanger that will require only relatively brief shutdown periods as a result of solids accumulations or to needed repair due to corrosive action on exposed walls.

SUMMARY OF THE INVENTION

Figure 1:
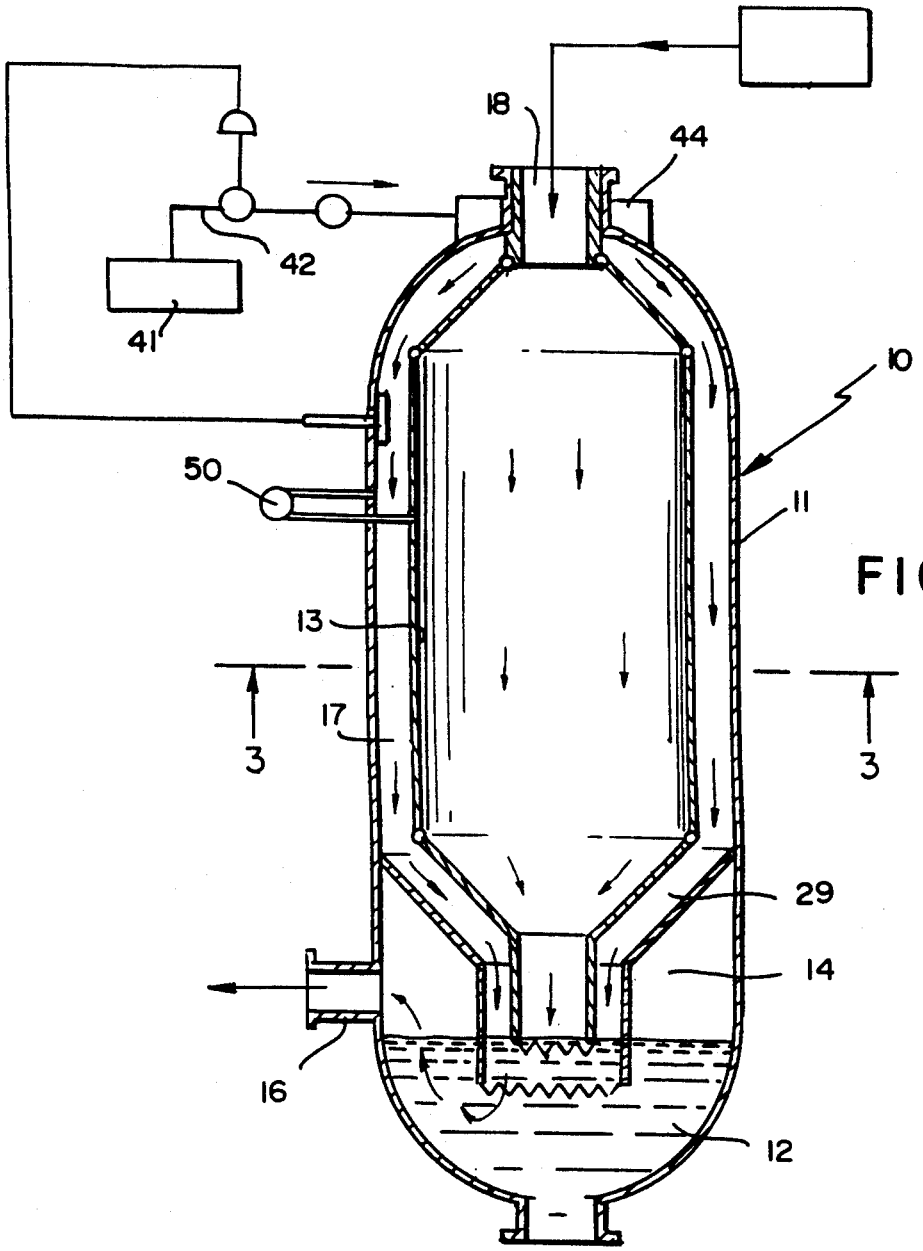
FIG. 1 is an elevation view in cross-section of a radiant synthetic gas cooler having a purging facility.

Briefly stated, the invention concerns a syngas cooler 10 and particularly a radiation type cooler comprised of an outer shell 11 having an inlet at the upper end. A water bath 12 at the shell lower end receives a stream of a hot effluent comprised of produced syngas, together with entrained solids. Solid material is substantially removed from the effluent stream in the water bath. Any residual solids are then carried by cooled gas into a separation chamber or disengaging zone 14. They are thereafter conducted from the cooler by way of discharge port 16.

A water wall 13 is spaced inwardly of outer shell 11 for radiation heat exchange with the hot syngas to the liquid circulated in the water wall tubes. Water wall 13 thereby defines an annulus or elongated annular chamber 17 with the inner wall of shell 11.

Referring to FIG. 1, the elongated outer shell 11 of cooler 10 is fabricated of metal, usually steel, capable of withstanding a limited degree of pressure, as well as relatively high temperatures. It is, however, incapable of overcoming the high temperatures normally expected in the gaseous effluent received from a gasifier.

Elongated shell 11 as shown, is provided at the upper end with an effluent inlet means 18. The shell lower end is provided with a first dip tube 19 which depends at a peripheral joint from the inner wall of the shell 11 and constricts flowing purge gas to a narrow discharge port 31. Water bath 12 within the lower end of shell 11 is located beneath the first dip tube such that the latter is normally submerged beneath the water bath surface.

Figure 3:
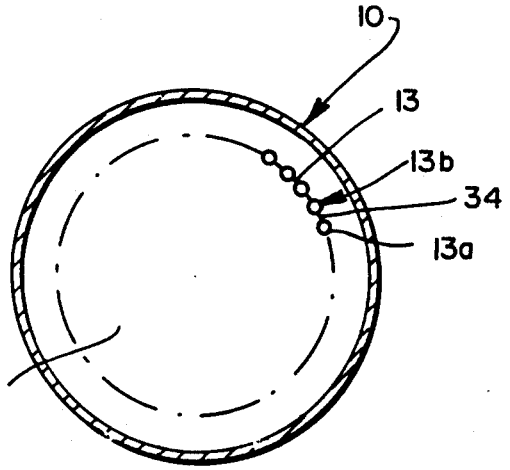
FIG. 3 is a cross sectional view taken along lines 3—3.

Elongated water wall 13 positioned within shell 11 is disposed with its exterior surface extending contiguous with the shell inner surface, but spaced from the latter such that elongated annulus 17 is defined therebetween. As shown in FIG. 3, water wall 13 is comprised of a plurality of circularly spaced heat conductive tubes 13*a* and 13*b* having a common manifold 23 at the upper end which is communicated to a pressurized source of water. Functionally, the water provides a circulating heat transfer medium. The respective adjacent tubes 13*a* and 13*b* are connected one to the other, or joined by an intermediate webbing 34 to render the wall impervious to the hot effluent stream which is deposited into the water wall's internal chamber 24.

As hot gaseous effluent, still under relatively high pressure from the gasifier, is forced downwardly through conduit 33 into internal chamber 24, this flow will be constricted by a first dip tube 19 which depends from the water wall 13 lower end.

A second dip tube 27 is shaped similarly to the configuration of first dip tube 19 and spaced from the latter to define a conical passage 29 therebetween which terminates in an elongated annular gas flow passage 31.

As cooled gaseous effluent passes through second dip tube 27 it will be directed into the water bath 12. At this point, the major part of the solid particulate matter contained in the effluent will be quenched, cooled, and gravitated to the water bath bottom. It will then be periodically removed by way of port 32, through a lockhopper or similar arrangement not shown.

It can be appreciated that not all of the particulate matter will be carried through the water bath 12 by sinking through the latter. A residual amount of the solids will be carried on the quenched effluent gas through the agitated water bath and into the upper section of disengaging zone 14. In the latter, both the cooled gas, as well as the solid matter, will be carried through discharge conduit 16 and into the next or downstream apparatus for further processing.

At discharge port 16 the probability is prevalent for an accumulation of the cooled particulate matter. As the latter approaches and passes through the constricted discharge port, it will tend to engage and adhere to the sides of the latter and eventually build or accumulate. The resulting mass 37 could, over a period of time, block the passage or flow of cooled effluent gas.

When such a condition continues unchecked, the buildup of back pressure against water bath 12 will in turn exert a back pressure along the internal chamber 24 of water wall 13. In the presently disclosed design, however, excessive differential pressure across water wall 13 is avoided. This is achieved by means of passages 31 and 29, through which the pressure across the water wall is equalized, thereby preventing a rupture of water wall 13.

As noted above, if a rupture of water wall 13 does occur, outer shell 11 would be exposed to contact with excessively hot gas. When the latter occurs, since the outer shell 11 is not constructed to safely contain the gas at the temperature and pressure at which it will be, the shell is susceptible to being damaged and thermally stressed to the point where, if preventive measures at not taken, it will rupture.

Failure of water wall 13 can also occur from corrosion. Corrosive components in the syngas, such as hydrogen sulfide, can migrate into annulus 17 thereby exposing the external surface of water wall 13 to corrosion. The inner surface of shell 11 can also be exposed to these corrosive components.

Toward overcoming, or at least minimizing, the possibility of such an occurrence, the presently disclosed constant purge system is designed to maintain a dynamic yet safe atmosphere in the annulus 17. This is achieved by maintaining a flow of purge gas through the annulus prior to depositing it into the water bath to intermix with produced gas.

Figure 2:
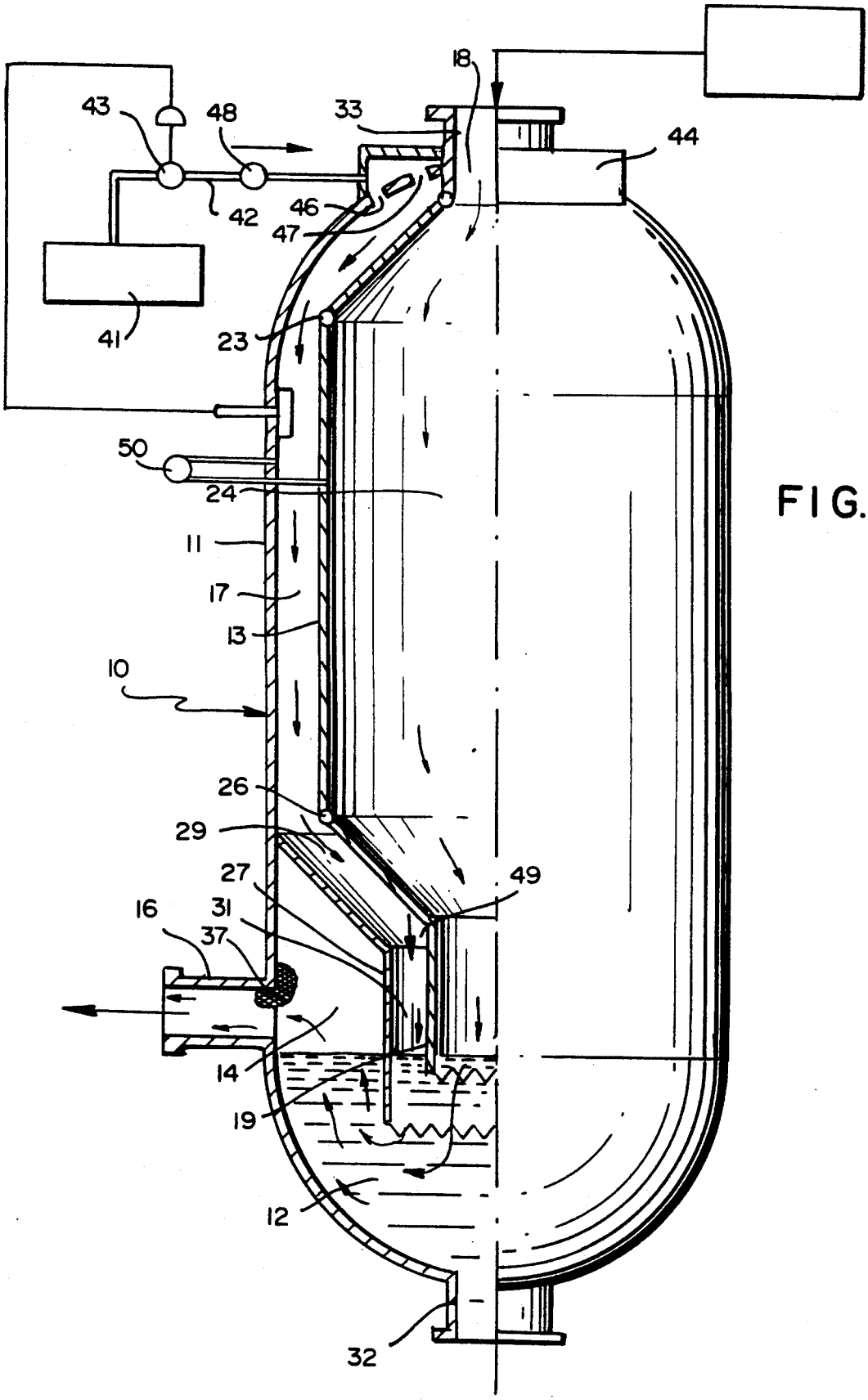
FIG. 2 is an enlarged, partially cross sectional view of FIG. 1.

Referring to FIGS. 1 and 2, the instant purge system is comprised primarily of a pressurized source 41 of a purge fluid such as a non-reactive or inert gas, nitrogen or even the dry synthesis gas, being examples. The gas is maintained preferably at a pressure comparable to or slightly greater than the pressure normally experienced in chamber 24 due to the presence of hot effluent The purge gas is conducted through a first conductor 42 by way of a flow regulator 43 and introduced into a manifold 44 formed at the upper end of cooler shell 11, preferably along the shell's outer surface. Flow rate sensing device 48 continuously monitors and records the flow of the purge gas.

At least one differential pressure sensing device 50 continuously monitors the differential pressure across water wall 13. Said device 50 is similar to that described in U.S. Pat. No. 4,876,987.

Manifold 44 is contiguous with the upper wall of the shell and includes at least one and preferably a plurality of circularly arranged ports 46 and 47. The latter are of a sufficient size to permit a steady inflow of the purge gas into annulus 24. The gas will thus sweep or scour the contiguous inner wall of shell 11 as well as the outer surface of water wall 13. The continuous sweeping action will avoid the generation of an acid or corrosive condition at any point along the annulus walls. It will then be conducted through the annular discharge passage 31 and into water bath 12.

The flow of the purge gas is also used to detect the presence of any blockage in passage 31. Should such a blockage form, a change in the flow rate of the purge gas will be detected by flow sensing device 48. Also, blockage of passage 31 will result in an increase in the differential pressure across the water wall. This will be sensed by differential pressure monitoring device 50.

Referring to FIG. 2, the outer surface of dip tube 19 is cooled by a constant supply of water that is introduced by means of quench ring 49 to prevent overheating of dip tube 19. This water then flows into water bath 12 where it is used to quench the synthesis gas.

The concentric lower ends of the respective first dip tube 19 and the discharge port of second dip tube 27 are notched, slotted, or otherwise serrated at the lower end. This configuration is found to promote an improved, relatively uniform flow of produced gas from the effluent passing through central chamber 24.

The particle carrying synthesis and purge gases will be chilled in the quench water bath 12, thereby allowing the heavier solids to gravitate toward the bath floor and eventually be discharged through port 32.

As can be expected, a considerable amount of turbulence will occur in the water bath 12. This turbulence promotes the carrying of some of the solid particles upward and into the separation or disengagement chamber 14.

In disengagement chamber 14, the major part of quench water will be separated from the gas and from any particulate material which has been carried from the bath. Said material, as previously noted, will tend to aggregate in the vicinity of the discharge and preferably along the walls of the discharge port 16. However, the improved upward flow of solids and bubbles through the water bath will avoid or substantially reduce the tendency for solids accumulation.

It is understood that although modifications and variations of the invention can be made without departing from the spirit and scope thereof, only such limitations should be imposed as are indicated in the appended claims.

I claim:

1. A radiant syngas cooler for treating a stream of hot, particulate-containing synthesis gas effluent, which cooler comprises an elongated upright shell (11), a water bath (12) at the shell lower end, a first dip tube (27) depending from said shell and defining a disengagement zone at the shell lower end above said water bath, a water wall (13) extending internally of said shell forming an internal chamber (14) and being spaced from the inner wall of said shell to define an elongated annulus (17) therebetween, inlet means in said shell communicated with said internal chamber (14) to conduct said stream of hot particulate-containing syngas thereto, a second dip tube (19) depending from said water wall (13), spaced inwardly of said first dip tube (27) to define a constricted annulus (31) therebetween which terminates in said water bath(12), flow control means for communicating said annulus (17) with a pressurized source of a purge gas, whereby said purge gas and said particulate-carrying synthesis gas will enter said bath concurrently, and at least one gas discharge port communicated with said disengagement zone to conduct cooled gas therefrom.

2. In a radiant syngas cooler as defined in claim 1 wherein said flow control means comprises at least one flow control valve in response to a pressure differential in said elongated annulus (17).

3. In the apparatus as defined in claim 1 including pressure sensing means communicated with said elongated annulus 17 for monitoring the pressure therein.

4. In a radiant syngas cooler as defined in claim 2 wherein said flow control means is adjustable to vary the volumetric flow of purged gas from said pressurized source thereof in response to a pressure sensed in said elongated annulus (17).

5. In the apparatus as defined in claim 1 wherein the pressurized source of purge gas si a chemically inert gas.

6. In the apparatus as defined in claim 1 wherein said pressurized source of purge gas contains primarily nitrogen.

7. In the apparatus as defined in claim 1 wherein the pressurized purge gas source is comprised at least in part of produced synthesis gas.

8. In the apparatus as defined in claim 3 wherein said pressure sensing means is operable to maintain the pressure within said elongated annulus 17 at a pressure in excess of the pressure in said internal chamber.

9. In the apparatus as defined in claim 1 wherein said first and second dip tubes are adjacently positioned in said shell to define a passage communicating said elongated annulus with said water bath.

* * * * *